US009150795B2

(12) United States Patent
Milani et al.

(10) Patent No.: US 9,150,795 B2
(45) Date of Patent: Oct. 6, 2015

(54) MULTI-STAGE COUNTER-CURRENT FROTH SETTLER AND METHOD OF USE

(71) Applicant: TOTAL E&P CANADA LTD., Calgary (CA)

(72) Inventors: Ali Milani, Paris (FR); Alan Rhodes, Calgary (CA)

(73) Assignee: TOTAL E&P CANADA LTD., Calgary (CA)

( * ) Notice: Subject to any disclaimer, the term of this patent is extended or adjusted under 35 U.S.C. 154(b) by 433 days.

(21) Appl. No.: 13/623,924

(22) Filed: Sep. 21, 2012

(65) Prior Publication Data

US 2013/0075306 A1 Mar. 28, 2013

Related U.S. Application Data

(60) Provisional application No. 61/537,935, filed on Sep. 22, 2011.

(51) Int. Cl.

| | |
|---|---|
| ***C10G 21/00*** | (2006.01) |
| ***C10G 33/06*** | (2006.01) |
| ***C10G 1/04*** | (2006.01) |

(52) U.S. Cl.

CPC ..... *C10G 33/06* (2013.01); *C10G 1/047* (2013.01); *C10G 21/00* (2013.01)

(58) Field of Classification Search

CPC ..... C10G 33/06; C10G 1/047

USPC ..... 208/390; 196/46

See application file for complete search history.

(56) References Cited

U.S. PATENT DOCUMENTS

| | | | | |
|---|---|---|---|---|
| 2,871,180 | A | 5/1957 | Lowman, Jr. et. al. | |
| 4,116,809 | A * | 9/1978 | Kizior | 208/425 |
| 2009/0294332 | A1 * | 12/2009 | Ryu | 208/390 |
| 2010/0096297 | A1 * | 4/2010 | Stevens et al. | 208/45 |

FOREIGN PATENT DOCUMENTS

CA 2502329 * 9/2006

OTHER PUBLICATIONS

Paper 2003-010; "Towards the improvement of the efficiency of oil sands froth treatment"; Romanova et al; Petroleum Society's Canadian International Petroleum Conference; 2003.

"Selective solvent deasphalting for heavy oil emulsion treatment"; Long et al. in Asphaltenes, Heavy Oils & Petroleomics; 2007; pp. 511-547.

* cited by examiner

*Primary Examiner* — Randy Boyer
*Assistant Examiner* — Juan Valencia
(74) *Attorney, Agent, or Firm* — Goodwin Law; Linda M. Thompson

(57) ABSTRACT

A method of recovering bitumen from a froth utilizes solvent and a single settling vessel having a plurality of internals. The froth is diluted with enough solvent to reduce viscosity and is added to the vessel above the internals. Additional solvent is added below the internals, intermediate the internals or both and is flowed counter-current to the diluted froth flowing downwardly over the internals, forming a gradient of solvent concentration relative to hydrocarbon concentration throughout the internals, acting as multiple stages of separation. The bitumen and other light components, rise with the solvent to the top of the vessel. The heavier components, such as water, solids and asphaltene aggregates fall to the bottom by gravity. Where paraffinic solvents are used, the solvent-to-bitumen ratio (S:B) for the initial dilution of froth is below that at which asphaltenes are rejected. Substantially all asphaltene rejection occurs in the vessel as S:B increases therein.

22 Claims, 7 Drawing Sheets

MULTI-STAGE COUNTER-CURRENT FROTH SETTLER AND METHOD OF USE

CROSS-REFERENCE TO RELATED APPLICATIONS

This application claims the benefit of U.S. Provisional Patent application Ser. No. 61/537,935, filed Sep. 22, 2011, the entirety of which is incorporated herein by reference.

FIELD OF THE DISCLOSURE

Embodiments disclosed herein relate to vessels for separation of components of slurries, and more particularly, to a multi-stage counter-current vessel and method of use for separation of components of a bitumen froth therein.

BACKGROUND

Many industrial processes require solid particles to be separated from a continuous liquid phase. In gravity separators, a slurry stream comprising liquid and solid particles is delivered to a vessel where the solid particles settle by gravity and are removed from the bottom of the vessel, while the clarified liquid is removed from the top of the vessel.

In the case of bitumen recovery, mined oil sand is typically mixed with warm water. The resulting slurry is piped to a primary gravity separation vessel PSV where the coarse solids fall to the bottom, a middlings stream containing some bitumen, fine solids and water is removed from the middle of the vessel and a froth containing bitumen, water and some fine mineral solids is removed from the top of the PSV. Typically, the froth comprises about 60% bitumen, 30% water and 10% fine solids.

The froth is further processed for removal of water and solids from the bitumen to permit further processing of the bitumen. It is known to use centrifuges, gravity separation vessels and inclined plate settlers to separate the bitumen from the water and the solids. The froth is typically diluted with a hydrocarbon solvent to reduce the viscosity and density of the oil phase prior to this further processing.

One such known froth separation process is taught in Canadian Patent 2,502,329 to Tipman et al. In this case, multiple stages of separation occur in three separate froth separation vessels which are utilized in a counter-current process for removal of water and solids from bitumen froth. Bitumen froth is diluted with solvent and added to the first froth separation vessel. The underflow is removed, mixed with additional solvent and is pumped to the second froth separation vessel. The overflow from the second vessel is returned to the first vessel and the underflow is mixed with additional solvent and is pumped to the third froth separation vessel. The overflow from the third vessel is pumped to the second vessel and the underflow is removed for tailings handling. The overflow from the first vessel is removed to a separation vessel for removal of solvent therefrom and the bitumen recovered is pumped to a facility for upgrading.

It is known to use both naphthenic and paraffinic solvents to reduce the viscosity and density of the oil phase of bitumen froth. In the case of paraffinic solvents, when sufficient solvent is added, asphaltenes are rejected from the froth upon contact between the solvent and the heavy hydrocarbon fraction. Large aggregates typically form between the water droplets, mineral solids and the rejected asphaltenes.

Centrifuges are typically energy intensive and gravity separation vessels generally have a very large footprint. Multiple gravity separation vessels, generally used with bitumen froth diluted in a light solvent, increase the probability and risk of breach of containment and have a large footprint. Inclined plate settlers typically have a smaller footprint however, as with the other separation equipment, more than one are required to increase the recovery of bitumen. Often combinations of the various apparatus are used in an attempt to optimize bitumen recovery.

Thus, conventional methods of separation are typically costly, require multiple pumps and other auxiliary equipment and require large volumes of solvent, for each of the separation units employed.

There is interest in froth separation apparatus and methods which are cost and energy effective, have a smaller footprint and which result in enhanced bitumen recovery therefrom.

SUMMARY

Embodiments disclosed herein utilize a single froth settling vessel having a plurality of internals for forming multiple stages therein to separate a bitumen froth containing at least bitumen, water and solids. The single vessel acts as a settling vessel wherein a froth diluted with solvent passes downwardly through the internals while additional of the solvent flows counter-current through the internals establishing a gradient of solvent concentration relative to hydrocarbon concentration therein. Bitumen and light components are carried with the solvent, by buoyancy, to the top of the vessel while solids and water fall to the bottom of the vessel. Advantageously, when the solvent and additional solvent are a paraffinic solvent or mixture of paraffinic solvents, asphaltene aggregates formed within the vessel assist in separating at least the water and the solids from the froth.

In one broad aspect, a method for separation of at least bitumen, solids and water from bitumen froth in a single vessel comprises diluting the bitumen froth with a solvent for reducing the viscosity thereof. The diluted bitumen froth is fed to a vessel, the vessel having a plurality of spaced apart internals positioned between a feed inlet, adjacent a top of the vessel for receiving the diluted bitumen froth, and a reject outlet at a bottom of the vessel. The plurality of spaced apart internals form a plurality of stages therebetween, the diluted bitumen froth flowing downward through the plurality of internals. Additional of the solvent is introduced to the vessel through one or more solvent inlets, such as positioned below the internals. The additional solvent flows upwardly therein, counter-current to the diluted bitumen froth, through the plurality of stages of internals and forms a gradient of solvent concentration relative to hydrocarbon concentration therein. A highest concentration of solvent is at the bottom of the vessel and a lowest concentration of solvent is at the top of the vessel. The at least solids and water settle through the plurality of stages of internals by gravity to the bottom of the vessel for removal therefrom. At least the bitumen is dissolved in the solvent for forming a product. The product rises through the plurality of stages of internals through buoyancy to a product outlet adjacent the top of the vessel for removal therefrom.

In another broad aspect, a method for separation of bitumen water and solids from a bitumen froth comprises diluting the froth with a solvent forming dilbit having a reduced viscosity. The dilbit is flowed through a settling vessel having a plurality of internals therein. Additional of the solvent is introduced to flow counter-current in the settling vessel for producing a product stream comprising at last bitumen and solvent at a top of the vessel.

Applicant believes that the addition of solvent in two parts, a first being solvent used to dilute the froth prior to the vessel and the second being additional solvent added in the vessel, provides significant advantages over the prior art.

In a first case, the two-part solvent addition provides a sufficiently diluted bitumen froth having a low viscosity solution of hydrocarbons in suspension with the solids and water in the froth. The diluted froth entering the single vessel is thus suitable for gravity separation in the vessel. The addition of additional solvent in the vessel flowing counter-current to the diluted froth creates a solvent gradient at the plurality of layers of internals within the vessel resulting in multi-stage separation in a single vessel. The water portion of the froth creates a water-rich phase near the bottom of the vessel which aids in minimizing loss of hydrocarbons and solvent to the reject stream.

Secondly, where the solvent is a paraffinic solvent, rejection of asphaltenes outside the vessel is minimized as the first solvent is added such that a solvent to bitumen ratio is maintained lower than that at which asphaltenes are rejected. Asphaltenes are thereafter rejected in the vessel with the addition of the additional paraffinic solvent. Applicant believes avoiding rejection of asphaltenes in mixing equipment and the like prior to the vessel minimizes subjecting the asphaltenes to shear stress prior to entering the settling environment in the single vessel. The reduction in shear results in the formation of an increased size of asphaltene aggregates which have an increased settling velocity.

Further, Applicant believes that oil captured inside the asphaltene aggregates formed at a top of the internals is recovered as the asphaltenes fall through the solvent gradient. With increasing solvent concentration in the single vessel, the equilibrium conditions are changed for each stage in the single vessel compared to the stage above, creating a diffusivity to extract the oil captured in the aggregates. Applicant believes that as the oil concentration inside the aggregates is significantly less than the oil concentration outside, there is impetus to extract the oil outside the aggregates so as to achieve an equilibrium between the oil inside and the oil outside the aggregates.

Embodiments described herein illustrate a method for settling of froth which is distinguished over prior art methods which utilize extraction vessels rather than a single settling vessel as described herein.

DETAILED DESCRIPTION OF THE PREFERRED EMBODIMENT

Figure 1:
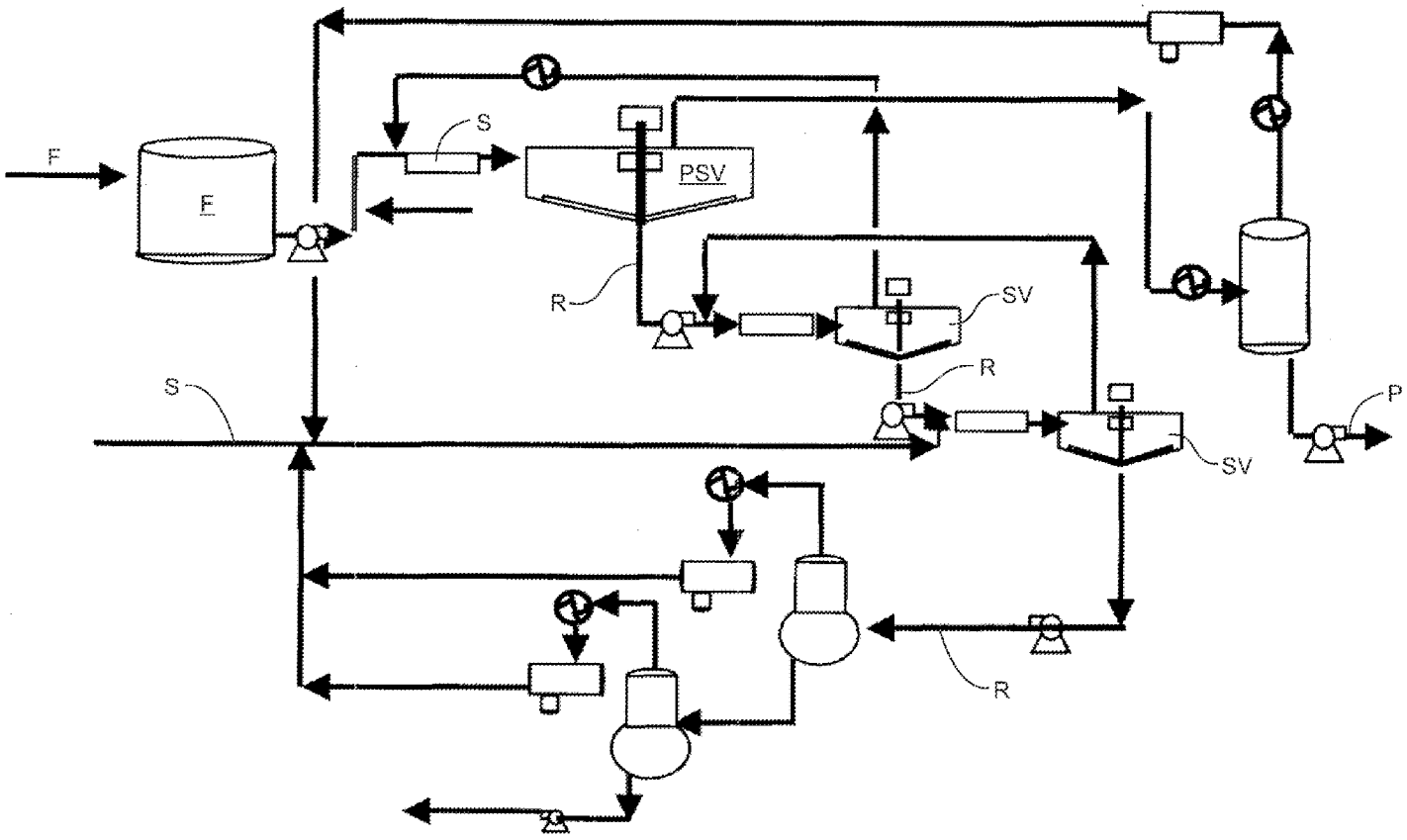
Fig. 1 PRIOR ART
FIG. 1 is a representative illustration of a system for separation of at least bitumen, solids and water from a bitumen froth using a plurality of settling vessels according to the prior art.

As shown in FIG. 1, prior art processes for the separation of a bitumen slurry or froth F into at least a product stream P, comprising bitumen and a reject stream R comprising at least solids, utilize a plurality of separation vessels having no internals, such as a primary gravity separation vessel PSV and one or more subsequent separation vessels SV. Typically, the bitumen froth is diluted and mixed with solvent S, such as in an inline mixer, to form a diluted bitumen or dilbit prior to the primary gravity separation vessel PSV. Additional solvent S may be added underflows from the primary or subsequent separation vessels PSV, SV prior to delivery to a subsequent separation vessel SV. If the solvent is paraffinic, rejection of asphaltenes typically occurs before the dilbit enters the separation vessels PSV, SV.

In embodiments of a method disclosed herein for removing at least solids T and water W from a bitumen froth F, a single separation vessel 10 having a plurality of internals 12 and operated according to embodiments of the method, is capable of achieving at least a degree of separation previously accomplished in a series of gravity separation vessels GSV or other separation apparatus, such as centrifuges, cyclones or inclined plate separators, or combinations thereof.

In embodiments, the feed stream F is a froth resulting from conventional production/extraction processes from oil sand. The bitumen froth F typically comprises about 60% bitumen, 30% water and 10% fine solids. The froth F is initially diluted with a solvent S for reducing the viscosity and density of the oil phase in the froth F, before entry to the vessel 10. Typically, additional of the same solvent S is also introduced directly to the vessel 10 to flow counter-current to the froth F which is flowing downward therein. The solvent S can be a single solvent or a mixture of solvents, as is understood by those of skill in the art.

Figure 2:
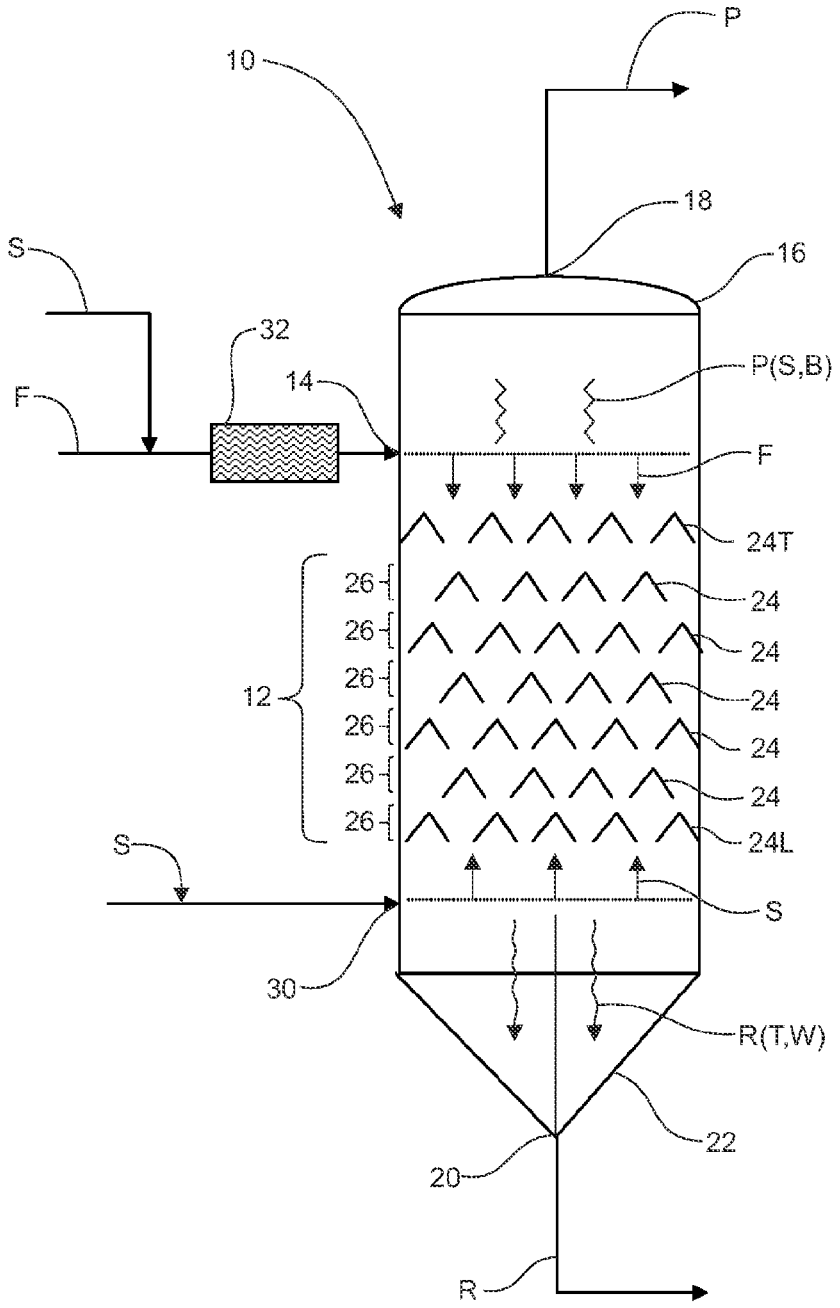
FIG. 2 is a representative illustration of a system according to an embodiment for separation of bitumen froth utilizing a multi-stage vessel disclosed herein.

Having reference to FIG. 2, the single separation vessel 10 comprises a feed inlet 14 adjacent a top 16 of the internals 12 for receiving a feed stream F, such as a bitumen slurry or froth. The vessel 10 has a product outlet 18 at a top 16 of the vessel 10 for discharging a product stream P, typically a clarified bitumen B and solvent S stream, therefrom and a reject outlet 20 at a bottom end 22 of the vessel 10 for discharging a reject stream R comprising at least the solids T and water W therefrom. While FIG. 2 illustrates a conical bottom vessel, other configurations which permit removal of the reject stream R are possible.

The vessel 10 further comprises the plurality of internals 12 within the vessel 10 which are situated between the feed inlet 14 and the reject outlet 20. The internals 12 comprise a plurality of spaced layers 24 of internals forming a plurality of stages 26 therebetween, within the vessel 10. The plurality of stages 26 engage the feed stream F as it falls through the vessel 10, causing the feed stream F to "flow" from layer 24 to layer 24.

In embodiments, the spaced layers 24 of internals 12 comprise disc and donut internals, angle-iron shed decks and grids of pipes or the like. Contact surfaces 28 of the internals 12 are angled relative to horizontal for discharging the feed stream F downward through the plurality of stages 26 within the vessel 10. As the feed stream F engages the contact surfaces 28, the feed stream F is caused to slide along the angled surfaces 28 for passing the feed stream F downward from layer 24 to layer 24.

The vessel 10 further comprises one or more solvent inlets 30 for introducing the additional solvent S to the internals 12 for contact with the feed stream F therein. In an embodiment, the one or more of the solvent inlets 30 are below the internals 12. The solvent S rises in the vessel 10 and flows counter-current therein to the flow of the feed stream F, flowing downwardly therein. As the solvent S rises by buoyancy and contacts the feed stream F, lighter components of the froth F, typically the bitumen B, are dissolved and carried by buoyancy toward the top 16 of the vessel 10 and to the product outlet 18. Heavier components or reject R, typically the mineral solids T, the water W and portions of the bitumen which may be insoluble in the solvent S, continue to move downward through the internals 12 and the vessel 10 to the reject outlet 20 at the bottom 22 of the vessel 10, largely by gravity. As the solids T and water W fall within the vessel 10, the solids T and water W reach an interface which forms in the vessel 10 between a water-rich phase and a hydrocarbon-rich phase, typically at or below a lowest layer 24L of the internals 12. The level of the interface depends upon liquid level control in the vessel 10. The vessel 10 is designed to permit flexibility with respect to the location of the interface in the vessel 10.

As the additional solvent S passes through the internals 12, a gradient of concentration of solvent S relative to heavy hydrocarbon or bitumen B concentration, is formed therein, with the highest concentration of solvent S being at the lowest layer 24L of the internals 12 and the lowest concentration of solvent S being at a top layer 24T of the internals 12. As the feed stream F "flows" downward from layer 24 to layer 24 through the solvent gradient, the solvent concentration increases and acts effectively as a stage 26 of bitumen recovery. Thus, unlike the prior art, the feed stream F is treated through multiple stages 26 within a single vessel 10.

Figure 3:
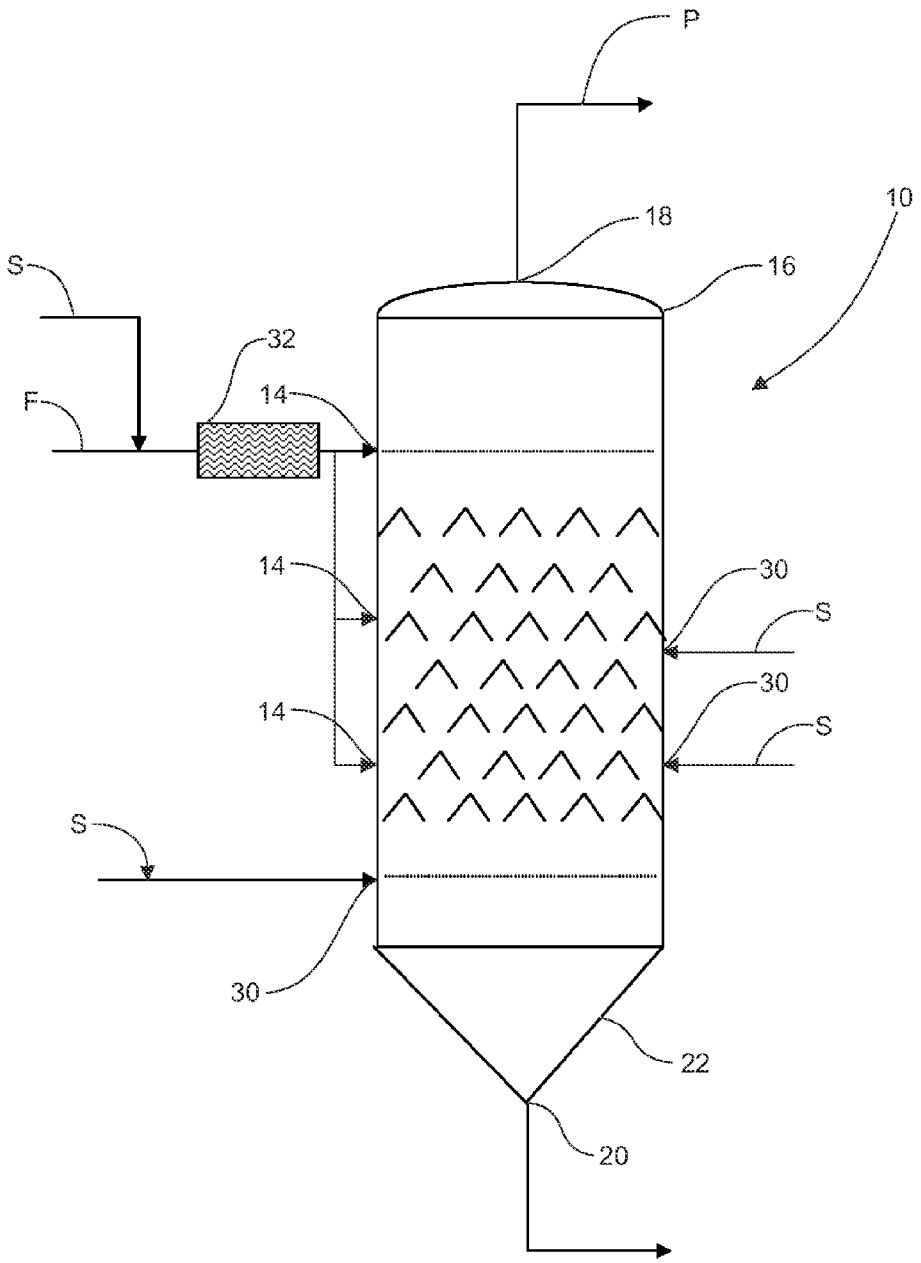
FIG. 3 is a representative illustration according to FIG. 2, illustrating a plurality of feed inlets and a plurality of solvent inlets.

In embodiments, as shown in FIG. 3, the vessel 10 may comprise additional feed inlets 14 above and/or intermediate the internals 12 for introducing the froth F to the vessel 10. Further, the additional solvent S may also be added to the vessel 10 through a plurality of solvent inlets 30 intermediate the internals 12, as well as below the internals 12.

If a naphthenic solvent is used, sufficient solvent S is added to the froth F to improve the fluid mechanics and fluid dynamics of the feed stream F in the vessel 10, allowing the feed stream F to flow over and through the internals 12 in the vessel 10.

If a paraffinic solvent S is used, sufficient solvent S is also added to the froth F to improve the fluid mechanics and dynamics of the feedstream. In addition, prior to introduction to the vessel 10, a ratio of paraffinic solvent to bitumen (S:B) is maintained below a ratio at which asphaltenes are rejected from the froth F. In this case, asphaltenes, which would otherwise deposit in mixing equipment, feed lines and in the feed inlet 14, are substantially prevented from doing so. For example, in the case of pentane, the S:B ratio is maintained at a ratio less than about 0.7.

Advantageously, when a paraffinic solvent S is used to dilute the froth F and to flow counter-current in the vessel 10 and the S:B ratio increases upon contact between the diluted feed stream F and the solvent S, asphaltenes are rejected from the froth F within the vessel 10 and the internals 12. The asphaltene aggregates which form are relatively large and act as flocculent for capturing at least some of the water droplets and mineral solids, creating even larger particles. Applicant believes that the amount of water droplets W and mineral solids T which are captured is significant. Thus, the quality of the reject stream R, being substantially bitumen-depleted water W and solids T, is improved.

In conventional vessels, the feed stream F and all of the solvent S are mixed prior to the at least a first of a plurality of vessels or separation apparatus, subjecting the feed stream, including aggregates formed therein, to high shear. Such high shear may reduce the size of the aggregates.

In contrast to the prior art, in embodiments disclosed herein, a minimum of solvent S to reduce the viscosity of the froth F is mixed, typically using mixing apparatus 32, with the froth F prior to feeding to the vessel 10. Applicant believes therefore that little shear is applied to the asphaltene aggregates as the aggregates form within the vessel 10 rather than in the mixing apparatus and delivery lines and flow through the vessel 10 and internals 12 therein. Applicant believes therefore that there is little disruption in the size of the aggregates which form, increasing the settling velocity and the flocculent-like action of the aggregates.

In embodiments where the S:B ratio of the feed stream F may exceed the ratio at which asphaltene rejection begins, some rejection of asphaltenes will occur in the mixing apparatus 32 prior to the vessel 10 and the aggregates will undergo shear as a result of the mixing apparatus 32 and pumping apparatus, if utilized. In this case, however, a significant amount of asphaltenes do not form until the diluted feed stream F reaches the vessel 10. The S:B ratio increases further after contacting the counter-current flowing additional solvent S in the vessel 10. Applicant believes that once the aggregates in the feed stream F enter the vessel 10, the aggregates, along with the aggregates which are formed therein, undergo the reduced shear within the vessel 10 for aiding gravity separation and the flocculent-like action.

The additional solvent S introduced to the vessel 10 may be heated however the solvent S is maintained at a temperature which is below the boiling point of the solvent S at operating pressure of the vessel 10. Operating pressures may vary, as is understood by those of skill in the art.

Figure 4:
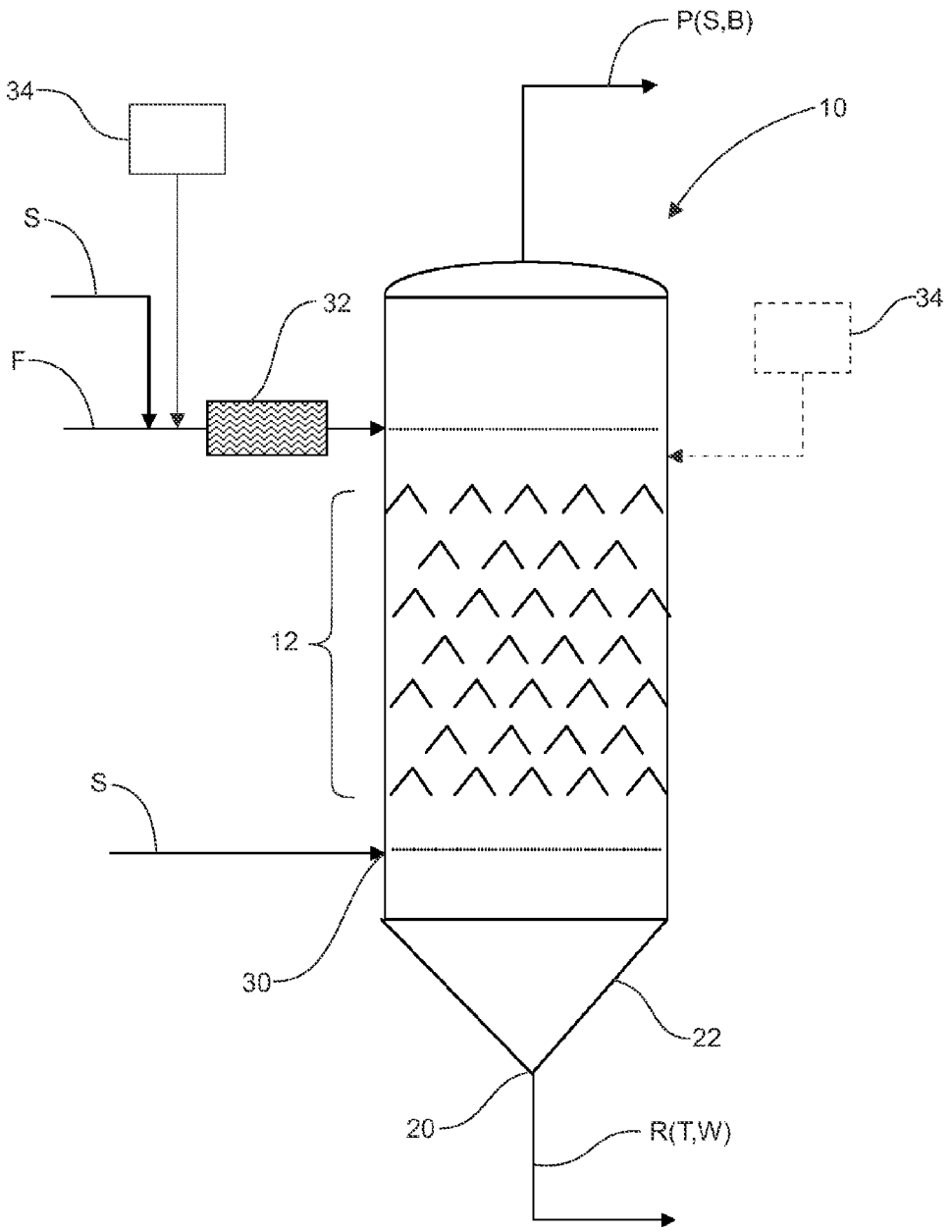
FIG. 4 is a representative illustration according to FIG. 2, illustrating optional addition of asphaltene dispersant to the feed stream or to the vessel.

In embodiments, as shown in FIG. 4, the feed stream F may further comprise asphaltene dispersants 34 which are added to the froth F or within the vessel 10 to improve the fluidity of high density components therein, which include the asphaltene aggregates produced when paraffinic solvents S are used.

Figure 5:
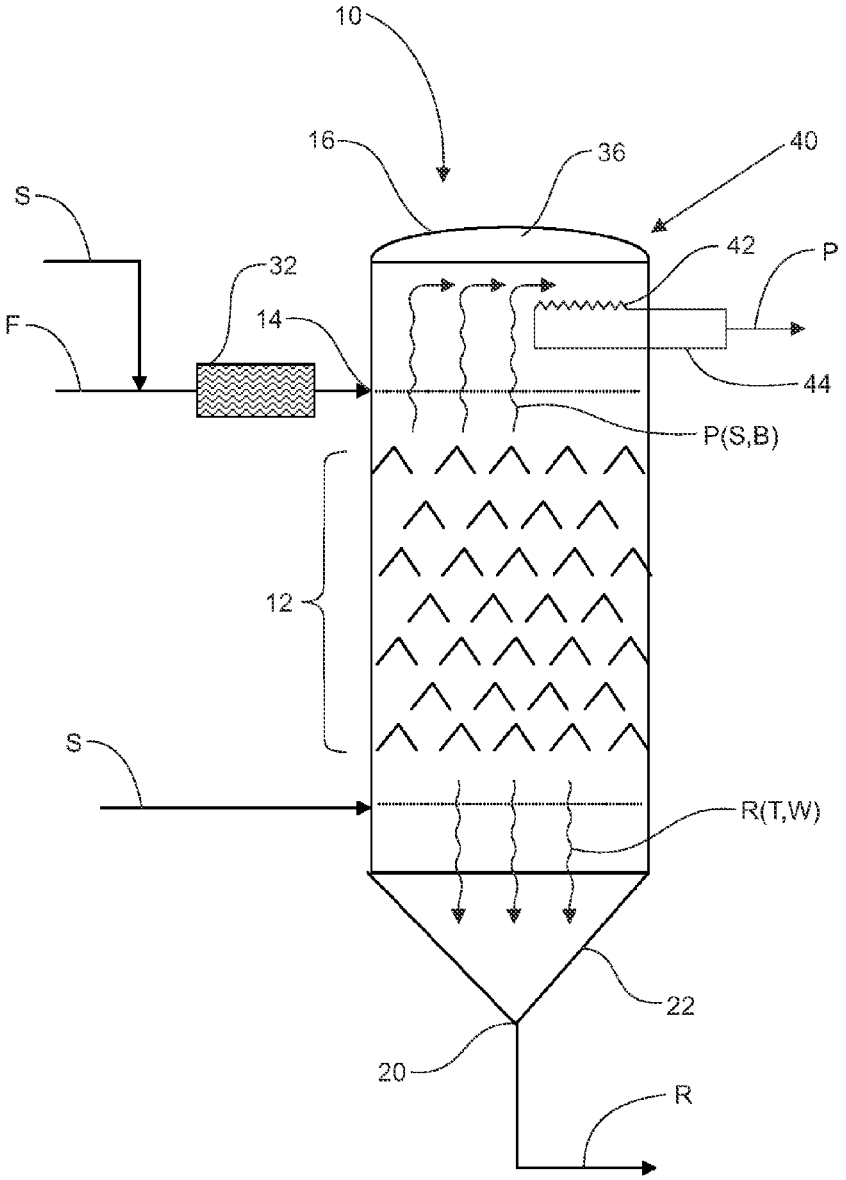
FIG. 5 is a representative illustration wherein a vessel, according to FIG. 21, further comprises a vapor space at a top end and a liquid collection system therebelow.

Optionally, having to FIG. 5, a vapor space 36 may be maintained adjacent the top 16 of the vessel 10. In this case, removal of the clarified phase or product P from the top 16 of the vessel 10 would occur below the vapor space 36, as is understood by those of skill in the art. Where a vapor space 36 is not maintained, other liquid handling systems 40 may be put into place as would be understood by those of skill in the art.

In steady-state operation, the vessel 10 is substantially filled with liquid. Having reference again to FIG. 5, in an embodiment incorporating a liquid collection system 40, a weir 42 adjacent the top 16 of the vessel 10 collects the product stream P, being a light bitumen-rich liquid overflow or product P, for delivery to a launder 44. The bitumen-rich product P is pumped or flowed by gravity from the launder 44 for further processing. The heavy solid or reject stream R, which comprises the water, the minerals solids, including the asphaltene aggregates if paraffinic solvents are used, collects at the bottom 22 of the vessel 10. The reject R is pumped from the reject outlet 20 or is flowed therethrough under the influence of a pressure differential, such as created by a flow valve, or any other such means as is understood by those of skill in the art.

Figure 6:
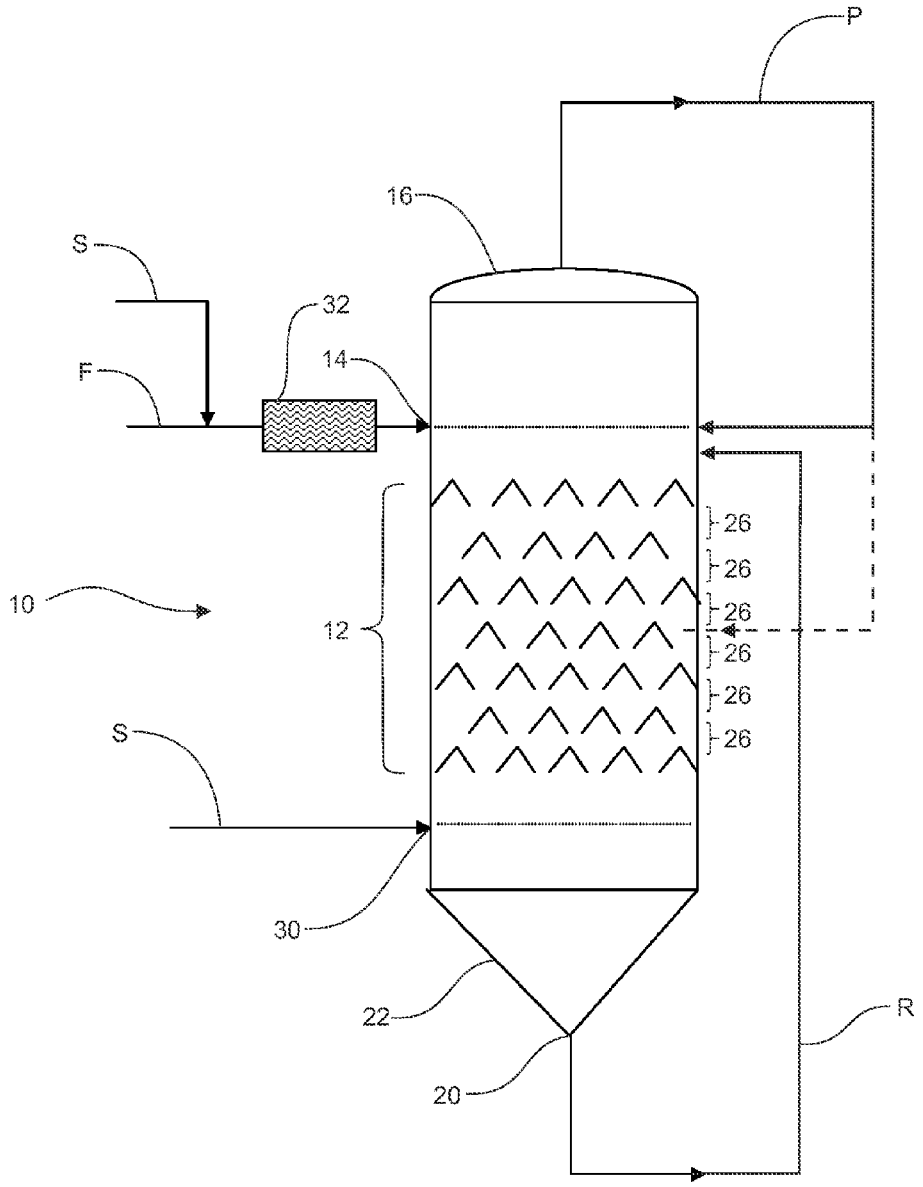
FIG. 6 is a representative illustration according to FIG. 2 further comprising recycle of the product or reject to the vessel.

In other embodiments, as shown in FIG. 6, either or both of the product P or the reject R can be recycled into the vessel 10 at any stage 26 of the vessel 10 for further bitumen recovery, effectively adding additional stages of treatment in a single vessel 10.

Figure 7:
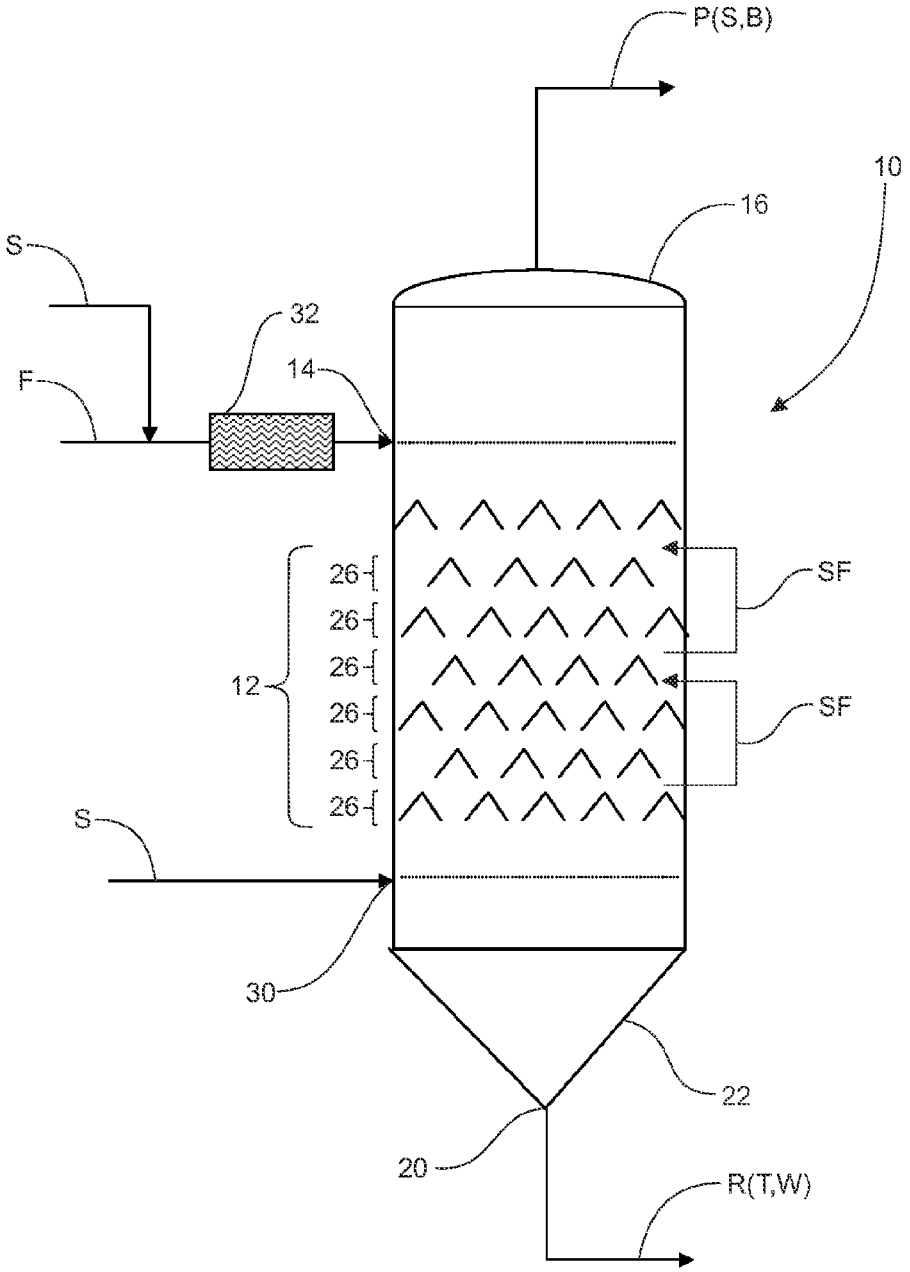
FIG. 7 is a representative illustration according to FIG. 2 further comprising recycle from an intermediate internal stage of the vessel to another internal stage of the vessel.

Further, in embodiments, as shown in FIG. 7, one or more intermediate streams SF, resulting from the rising solvent S and the downward flowing feed stream F, can be removed from intermediate stages 26 of the vessel 10 and returned to another stage 26 of the vessel 10 to increase the number of stages 26 of treatment using the single vessel 10.

The embodiments in which an exclusive property or privilege is claimed are defined as follows:

1. A method for separation of at least bitumen, solids and water from a bitumen froth in a single vessel, the method comprising:

diluting the bitumen froth with a paraffinic solvent for reducing the viscosity thereof, a solvent-to-bitumen ratio therein being maintained below a ratio at which asphaltenes are rejected from the bitumen froth;

feeding the diluted bitumen froth to the single vessel, the vessel having a plurality of spaced apart internals positioned between a feed inlet, adjacent a top of the vessel for receiving the diluted bitumen froth, and a reject outlet at a bottom of the vessel, the plurality of spaced apart internals forming a plurality of stages therebetween, the diluted bitumen froth flowing downward through the plurality of internals; and introducing additional of the paraffinic solvent to the vessel through one or more solvent inlets positioned below the internals, the additional solvent flowing upwardly therein, counter-current to the diluted bitumen froth, through the plurality of stages of internals and forming a gradient of solvent concentration relative to hydrocarbon concentration therein, a highest concentration of solvent being at the bottom of the vessel and a lowest concentration of solvent being at the top of the vessel, the solvent-to-bitumen ratio within the plurality of stages being sufficiently high to reject asphaltenes therefrom, wherein the at least solids and water settle through the plurality of stages of internals by gravity to the bottom of the vessel for removal therefrom; and at least the bitumen is dissolved in the solvent for forming a product, the product rising through the plurality of stages of internals through buoyancy to a product outlet adjacent the top of the vessel for removal therefrom.

2. The method of claim 1, wherein the plurality of spaced apart internals are angled relative to horizontal for flowing the diluted bitumen froth downward therethrough.

3. The method of claim 1, wherein the rejected asphaltenes capture water and flocculate solids settling by gravity therein, thereby increasing the settling velocity of at least the water and solids.

4. The method of claim 1 further comprising maintaining the solvent at a temperature below the boiling point of the solvent at vessel operating pressures.

5. The method of claim 1 further comprising:

adding an asphaltene dispersant to the diluted bitumen froth prior to feeding the diluted bitumen froth to the vessel.

6. The method of claim 1 further comprising:

adding an asphaltene dispersant to the vessel.

7. The method of claim 1 further comprising:

removing a reject stream from the reject outlet at the bottom of the vessel and reintroducing the reject stream to the vessel above the plurality of stages of internals.

8. The method of claim 7 further comprising:

reintroducing the reject stream to the multi-stage vessel intermediate the plurality of stages of internals.

9. The method of claim 1 further comprising:

removing the product stream from the product outlet; and reintroducing the product stream to the multi-stage vessel above the plurality of stages of internals.

10. The method of claim 9 further comprising:

reintroducing the product stream to the multi-stage vessel intermediate the plurality of stages of internals.

11. The method of claim 1 further comprising:

introducing the additional solvent intermediate the plurality of stages of internals.

12. The method of claim 1 wherein the solvent and additional solvent are pentane and the solvent to bitumen ratio prior to feeding the diluted bitumen froth to the feed inlet is maintained at less than about 0.7.

13. A method for separation of bitumen, water and solids from a bitumen froth comprising:

diluting the froth with a paraffinic solvent forming dilbit having a reduced viscosity, wherein a solvent-to-bitumen ratio therein is maintained at less than a ratio at which asphaltenes are rejected;

flowing the dilbit through a settling vessel having a plurality of internals therein; and introducing additional of the paraffinic solvent to flow counter-current therein for producing a product stream comprising at least bitumen and solvent at a top of the vessel, wherein the solvent-to-bitumen ratio is increased upon introduction of the dilbit to the setting vessel causing asphaltene rejection therefrom.

14. The method of claim 13 further comprising:

adding an asphaltene dispersant to the dilbit prior to feeding the diluted bitumen froth to the vessel.

15. The method of claim 13 further comprising:

adding an asphaltene dispersant to the vessel.

16. The method of claim 13 further comprising:

removing a reject stream comprising at least water and solids from the vessel.

17. The method of claim 16 further comprising:

reintroducing the reject stream to the vessel above the plurality of internals.

18. The method of claim 16 further comprising:

reintroducing the reject stream intermediate the plurality of internals.

19. The method of claim 13 further comprising:

introducing the additional of the solvent below the plurality of internals.

20. The method of claim 13 further comprising:

introducing the additional of the solvent intermediate the plurality of internals.

21. The method of claim 13 wherein the solvent and additional solvent are pentane and the solvent to bitumen ratio prior to feeding the diluted bitumen froth to the feed inlet is maintained at less than about 0.7.

22. A method for separation of at least bitumen, solids and water from a bitumen froth in a single vessel, the method comprising:

diluting the bitumen froth with a paraffinic solvent for reducing the viscosity thereof, a solvent-to-bitumen ratio therein being maintained below a ratio at which asphaltenes are rejected from the bitumen froth;

feeding the diluted bitumen froth to the single vessel, the vessel having a plurality of spaced apart internals positioned between a feed inlet, adjacent a top of the vessel for receiving the diluted bitumen froth, and a reject outlet at a bottom of the vessel, the plurality of spaced apart internals forming a plurality of stages therebetween, the diluted bitumen froth flowing downward, without shear, through the plurality of internals; and introducing additional of the paraffinic solvent to the vessel through one or more solvent inlets positioned below the internals, the additional solvent flowing upwardly therein, counter-current to the diluted bitumen froth, through the plurality of stages of internals and forming a gradient of solvent concentration relative to hydrocarbon concentration therein, a highest concentration of solvent being at the bottom of the vessel and a lowest concentration of solvent being at the top of the vessel, the solvent-to-bitumen ratio within the plurality of stages being sufficiently high to reject asphaltenes therefrom, wherein the at least solids and water settle through the plurality of stages of internals by gravity to the bottom of the vessel for removal therefrom; and at least the bitumen is dissolved in the solvent for forming a product, the product rising through the plurality of stages of internals through buoyancy to a product outlet adjacent the top of the vessel for removal therefrom.

* * * * *